US007500896B2

(12) United States Patent
Trushell et al.

(10) Patent No.: US 7,500,896 B2
(45) Date of Patent: Mar. 10, 2009

(54) METHOD OF MANUFACTURING A FLUORESCENT LAMP HAVING GETTER ON A UV REFLECTIVE BASE COAT

(75) Inventors: Charles Trushell, Manhattan, KS (US); Liviu Magean, Morgantown, WV (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 85 days.

(21) Appl. No.: 11/124,990

(22) Filed: May 9, 2005

(65) Prior Publication Data

US 2005/0197035 A1 Sep. 8, 2005

Related U.S. Application Data

(62) Division of application No. 10/017,360, filed on Dec. 14, 2001, now Pat. No. 6,919,679.

(51) Int. Cl.
*H01J 9/20* (2006.01)
*H01J 61/35* (2006.01)

(52) U.S. Cl. ..... 445/26; 313/489

(58) Field of Classification Search ..... 445/26, 445/29, 31; 313/489, 485, 553, 635
See application file for complete search history.

(56) References Cited

U.S. PATENT DOCUMENTS

| | | | | | |
|---|---|---|---|---|---|
| 3,377,494 | A | * | 4/1968 | Repsher | 313/489 |
| 3,833,399 | A | * | 9/1974 | Martyn et al. | 427/67 |
| 3,875,455 | A | * | 4/1975 | Kaduk et al. | 313/489 |
| 4,376,032 | A | * | 3/1983 | Givens | 208/424 |
| 4,980,049 | A | * | 12/1990 | Huh et al. | 208/113 |
| 5,552,665 | A | * | 9/1996 | Trushell | 313/489 |
| 6,016,034 | A | * | 1/2000 | Corazza et al. | 313/553 |

* cited by examiner

*Primary Examiner*—Karabi Guharay

(57) ABSTRACT

A method of manufacturing an electric lamp. An undercoat of getter precursor is applied to the lamp envelope. A layer of luminescent material is applied to the undercoat. The undercoat and layer of luminescent material are sintered to convert the getter precursor into gettering material. The luminous efficacy of the lamp is increased.

6 Claims, 1 Drawing Sheet

METHOD OF MANUFACTURING A FLUORESCENT LAMP HAVING GETTER ON A UV REFLECTIVE BASE COAT

This application is a divisional of application Ser. No. 10/017,360, filed Dec. 14, 2001, publication no. 2003-0111953, and issued on Jul. 19, 2005, as U.S. Pat. No. 6,919,679, the entire contents of which are hereby incorporated by reference.

FIELD OF THE INVENTION

This invention relates to low-pressure mercury vapor lamps, more commonly known as fluorescent lamps, having a lamp envelope with phosphor coating, and more particularly, to such lamps in which the amount of contaminants introduced into the lamp during manufacture has been reduced during lamp operation. This has the effect of reducing mercury consumption, improving maintained light output and improving arc stability at time of lamp ignition.

BACKGROUND OF THE INVENTION

Low-pressure mercury vapor lamps, more commonly known as fluorescent lamps, have a lamp envelope with a filling of mercury and rare gas to maintain a gas discharge during operation. The radiation emitted by the gas discharge is mostly in the ultraviolet (UV) region of the spectrum, with only a small portion in the visible spectrum. The inner surface of the lamp envelope has a luminescent coating, often a blend of phosphors, which emits visible light when impinged by the ultraviolet radiation.

There is an increase in the use of fluorescent lamps because of reduced consumption of electricity. To further reduce electricity consumption, there is a drive to increase efficiency of fluorescent lamps, referred to as luminous efficacy which is a measure of the useful light output in relation to the energy input to the lamp, in lumens per watt (LPW).

U.S. Pat. No. 5,552,665 Of Charles Trushell, an inventor in the present application, relates to an electric lamp having a luminescent layer on the lamp envelope which produces visible light when impinged by ultraviolet radiation generated within the lamp, and wherein an undercoat for the luminescent layer is employed. The disclosure of said patent is hereby incorporated by this reference thereto. Such an undercoat is now a common feature of modern fluorescent lamps, and is an oxidic, particulate base coat layer of non-fluorescent material, preferably an aluminum oxide, underlying the light-giving phosphor. Such an undercoat or base-coat is intended to economically increase light output, simplify the manufacturing process, improve the maintenance of light output, and reduce mercury consumption by the glass bulb. Typically, such layers are composed of very small particles with consequently large surface areas. Unfortunately, it has been found that the large surface of the particulate base-coat combined with the propensity of aluminum oxide to adsorb gaseous molecules results in larger than normal amounts of contaminants being introduced into the lamp interior during manufacture. For example, water and carbon dioxide are common, volatile, fluorescent lamp contaminants, the amounts of which are increased as a result of the large surface area of the undercoat. One effect of the increased amount of these contaminants is to increase the duration of arc instability immediately after lamp ignition.

It is known to coat the phosphor layer contained in a fluorescent lamp. For example:

Tamura, Japanese Patent Application No. 03179238 (Abstract)), describes a procedure wherein MgO is mixed with a phosphor at 0.01-1.0% and used to form a layer as a step in the manufacture of a fluorescent lamp in order to getter $CO_2$ and CO impurities which exist after the lamp is manufactured.

Watanabe et al, U.S. Pat. No. 5,604,396, describes a method wherein an alcoholic solution of a metal alkoxide (wherein the metal may be any of numerous metals including magnesium) is added to an aqueous suspension of a phosphor, which is to be coated by the alkoxide. Upon evaporation of the alcohol, the alkoxide is converted to the hydroxide and homogeneously precipitated on the surface of the phosphor in a sol-gel process. After removal of the water, the hydroxide-coated phosphor is fired at a high temperature; however, no specific benefits are claimed for coating the phosphor with the metal alkoxide. Moreover, we have found that coating the phosphor with metal alkoxide or metal oxide does not eliminate or mitigate the increase in duration of the arc instability in the lamp when an oxidic base-coat such as alumina is used.

There is a need in the art for a means of reducing the amount of contaminants and for eliminating or at least mitigating the increase in duration of arc instability to which the contaminants contribute in a fluorescent lamp.

SUMMARY OF THE INVENTION

An object of the invention is to provide a lamp in which the amount of contaminants is reduced and in which the arc instability to which the contaminants contribute is substantially eliminated.

The present invention accomplishes the above and other objects by providing an electric lamp that includes:

an envelope having an inner surface;

means within the lamp envelope for generating ultraviolet radiation;

a layer of a luminescent material adjacent to the inner surface of the lamp envelope for generating visible light when impinged by said ultraviolet radiation; and an undercoat layer between said inner surface of said lamp envelope and said layer of luminescent material, for reflecting ultraviolet radiation which has passed through said layer of luminescent material back into said luminescent material for increasing the visible light output of said luminescent material, said undercoat layer comprising a particulate non-fluorescent material derived from a sintered mixture of an aluminum oxide material and a getter material which is capable of irreversible reaction with contaminants present in the lamp.

In its preferred embodiments, said undercoat layer comprises a particulate oxidic material, preferably an aluminum oxide having on its surface, preferably as a contiguous layer, an oxide of an alkaline earth metal or zinc formed in situ during the lehring (sintering) process via reaction, for example, through thermal decomposition, of an alkaline earth metal oxide precursor material or zinc oxide precursor material or mixture thereof which reacts to form an alkaline earth metal oxide or zinc oxide or mixture thereof on said oxidic base-coat material.

In its most preferred embodiments, the undercoat layer comprises alumina having on its surface a contiguous layer of magnesium oxide formed in situ during the lehring (sintering) process as a result of thermal decomposition of an aqueous solution or suspension of a magnesium salt. In this way advantage is taken of the large surface area of the oxidic base-coat material, in part responsible for the arc instability, to act as the site for said irreversible reaction.

The preferred getter materials include oxides preferably of alkaline earth metals and/or zinc and include magnesium, calcium, strontium, barium, zinc, and mixtures thereof, formed in situ during the lehring (sintering) process by a precursor compound or mixtures of such compounds which are introduced as soluble compounds into an aqueous suspension of the aluminum oxide base-coat material. Mixtures forming magnesium oxide are particularly preferred for use as a getter compound for purposes of this invention.

Suitable precursor materials may be any alkaline earth metal or zinc compound or mixture thereof that reacts during the lehring step to form an alkaline earth oxide or zinc oxide or mixture of such oxides on the surface of the oxidic base-coat material. Illustrative of such precursor materials suitable for use herein are magnesium, calcium, strontium, barium, and zinc citrates, acetates, nitrates, etc. The preferred getter materials include oxides of alkaline earth metals and/or zinc, specifically oxides of magnesium, calcium, strontium, barium, zinc, and mixtures thereof, which are introduced as soluble compounds into the suspension of the oxidic base coat material. Precursor compounds of alkaline earth oxides and zinc oxide that crystallize during drying of the layer, without melting during subsequent processing, should be avoided.

BRIEF DESCRIPTION OF THE DRAWING

The FIGURE is a perspective view of a fluorescent lamp, partly in cross-section, partly broken away, having an undercoat with getter material according to the invention.

The invention will be better understood with reference to the details of specific embodiments that follow.

DETAILED DESCRIPTION OF THE PREFERRED EMBODIMENTS

Figure 1:
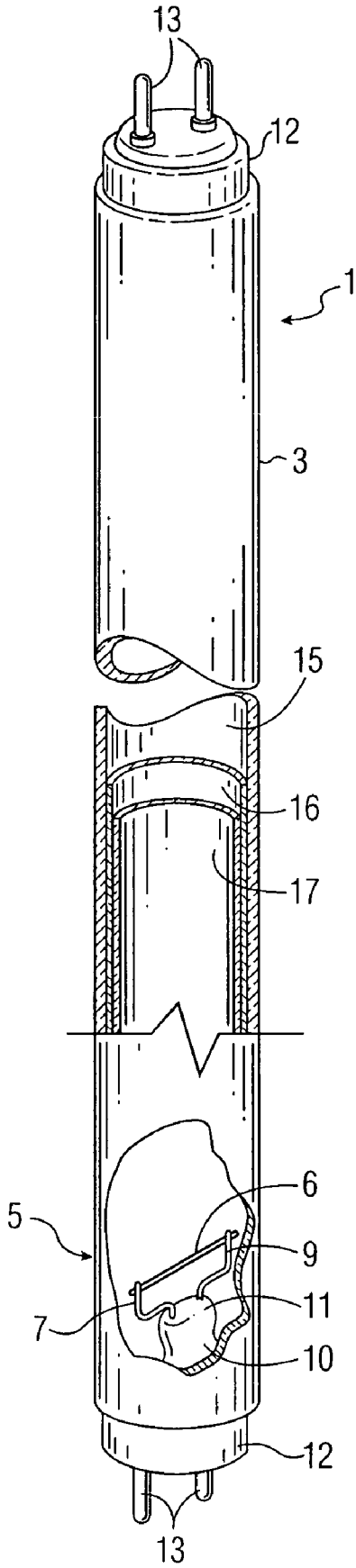

With reference to the FIGURE, there is illustrated a low-pressure mercury vapor discharge or fluorescent lamp 1 with an elongated outer envelope, or bulb 3. The lamp includes a conventional electrode structure 5 at each end which includes a filament 6 supported in in-lead wires 7 and 9 which extend through a glass press seal 11 in a mount stem 10. The electrode structure 5 is not the essence of the present invention, and other structures may be used for lamp operation to generate and maintain a discharge in the discharge space. For example, a coil positioned outside the discharge space may be used to generate an alternating magnetic field in the discharge space for generating and maintaining the discharge.

Returning to the illustrative lamp 1 of the FIGURE, the leads 7,9 are connected to pin-shaped contacts 13 of their respective bases 12 fixed at opposite ends of the lamp 1. The discharge-sustaining filling includes an inert gas such as argon, or a mixture of argon and other gases, at a low pressure in combination with a small quantity of mercury to sustain an arc discharge during lamp operation. The inner surface 15 of the outer envelope 3 is provided with an undercoat 16 of aluminum oxide (for example, Aluminum Oxide C available commercially from DeGussa or Baikalox CR30 from Baikowski Chemie) as a non-fluorescent material coated with a contiguous layer of an alkaline earth oxide mixture, formed by thermal decomposition of the appropriate precursor materials. This alkaline earth oxide represents from about 1 to about 3 wt. % of oxide based on the weight of the aluminum oxide as getter material to remove contaminants from the lamp. A phosphor coating 17 is disposed over the undercoat 16. Both coatings extend the full length of the bulb, completely circumferentially around the bulb inner wall.

The undercoat layer may be cast from organic solvent or water based suspensions to which various components may be added without substantially changing the various advantages of the non-fluorescent oxidic undercoat. The suspension is applied to the interior of a clean fluorescent tube in a manner known to the art and is then lehred or sintered, also in a manner well known in the art.

The bulb coated as above is then lehred and finished into a lamp in the manner known in the art.

To further reduce mercury consumption, the glass mount stems and press seals may also be coated with the aluminum oxide undercoat layer to reduce mercury bound to the glass mount stems and press seals.

This invention recognizes the discovery that alkaline earth metal oxides and/or zinc oxide, particularly when incorporated in aluminum oxide reflective undercoats via thermal decomposition of precursor materials during lehring, are effective to reduce or eliminate contaminants introduced into the lamp during manufacture and substantially reduces the duration of or eliminates arc instability immediately after lamp ignition. The invention was demonstrated in a series of 32T8 bulbs, 4 feet in length and 1 inch in diameter using about 0.5-1.0 grams of commercially available aluminum oxide containing about 1-3% MgO based on the weight of the aluminum oxide.

Representative lamps were produced in which the undercoat layer 16 comprises particulate aluminum oxide, i.e. alumina having on its surface a contiguous layer of a mixture of metal oxides including magnesium oxide. The alumina was suspended in a water-based solution to which an amount of magnesium nitrate is added, and flushed down the lamp tube or envelope 3 to flow over the envelope inner surface 15 until it exits from the other end. The solution was dried in a drying chamber. A phosphor coat 17 was applied in a similar fashion and sintered or baked for a period of time. The lamps thus produced exhibited a reduced period of arc instability after lamp ignition compared to lamps that were not so processed and treated and exhibited a substantially greater reduction in the period of arc instability after lamp ignition when compared to comparable lamps wherein the getter material was applied to a phosphor layer.

The phosphors suitable for use in this invention may vary according to the properties desired in the final lamp. For example, for a 4100K fluorescent lamp where the color temperature is about 4100° K, i.e., in degree Kelvin, the phosphor coat 17 is typically comprised of a mixture of three phosphors. The phosphor mixture typically consists of a blue-emitting barium magnesium aluminate (BAM) activated by Eu, a red-emitting yttrium Oxide (YOX) activated by Eu, i.e., $Y_2O_3$:Eu; and typically a green-emitting lanthanum phosphate (LAP) activated by cerium and terbium.

The three-phosphor mixture in the 4100° K lamp allows the lamp 1 to have reduced mercury consumption in conjunction with the alumina undercoat 16 which shields the glass envelope 3 from mercury.

Since very thin layers of the getter compounds are effective in gettering the contaminants in question, the optics of the bulk material are not effectively altered. The invention has been found to be useful in all UV reflective base coats in fluorescent lamps.

While not wishing to be bound by any theory, experimental data indicates that contamination above a certain level in the finished lamp results in increased duration of arc instability in conventional lamps and that decreasing the contamination reduces or eliminates the duration of the arc instability. Thus the solution according to this invention is the reduction of impurities responsible for the contamination by taking advantage of the large surface area provided by the UV reflecting base-coat.

While the present invention has been described in particular detail, it should also be appreciated that numerous modifications are possible within the intended spirit and scope of the invention. In interpreting the appended claims it should be understood that where and if it appears:

a) the word "comprising" does not exclude the presence of other elements than those listed in a claim;

b) the word "consisting" excludes the presence of other elements than those listed in a claim;

c) the word "a" or "an" preceding an element does not exclude the presence of a plurality of such elements.

d) any reference signs in the claims do not limit their scope; and e) several "means" may be represented by the same item of hardware or software implemented structure or function.

We claim:

1. A method of manufacturing an electric lamp comprising:

forming an aqueous suspension of a non-fluorescent oxidic material;

adding a water soluble getter precursor to the aqueous suspension to form a mixture;

forming a first coating on an inner wall surface of a lamp envelope with the mixture;

drying the first coating to form a single UV light reflective layer;

forming a second coating of a luminescent material over the dry first coating; and sintering the first and second coatings to form an undercoat layer on the inner wall surface, the undercoat layer consisting of aluminum oxide and zinc or alkaline earth metal oxide.

2. A method as set forth in claim 1, further comprising sealing the envelope just after the step of sintering.

3. The method of claim 1, wherein the undercoat layer consists essentially of aluminum oxide and magnesium oxide.

4. method of providing an undercoat capable of irreversible reaction with contaminants present in a contained gas, comprising:

depositing a first layer of undercoat material on an inner wall surface of a lamp envelope, the undercoat material comprising a water soluble getter precursor;

depositing on the first layer a second layer comprising luminescent material; and sintering the first and second layers to form an undercoat layer on the inner wall surface, the undercoat layer consisting of aluminum oxide and magnesium oxide.

5. The method of claim 4, wherein the undercoat layer is in a light reflective form.

6. The method of claim 4, further comprising sealing the lamp envelope just after the step of sintering.

* * * * *